US005472119A

United States Patent [19]

Park et al.

[11] Patent Number: 5,472,119

[45] Date of Patent: Dec. 5, 1995

[54] ASSEMBLY FOR DISPENSING FLUIDS FROM MULTIPLE CONTAINERS, WHILE SIMULTANEOUSLY AND INSTANTANEOUSLY VENTING THE FLUID CONTAINERS

[75] Inventors: Yeong C. Park, Bergen County, N.J.; Robert E. Corba, Racine County, Wis.

[73] Assignee: S. C. Johnson & Son, Inc., Racine, Wis.

[21] Appl. No.: 293,925

[22] Filed: Aug. 22, 1994

[51] Int. Cl.[6] ..... B67D 5/60

[52] U.S. Cl. ..... 222/145.8; 222/383.1; 222/484

[58] Field of Search ..... 222/145.1, 145.5, 222/382, 383.1, 136, 481.5, 484; 239/304

[56] References Cited

U.S. PATENT DOCUMENTS

| | | | |
|---|---|---|---|
| 2,941,696 | 6/1960 | Homm | 222/145.1 |
| 3,076,573 | 2/1963 | Thomas | 215/6 |
| 3,506,157 | 4/1970 | Dukess | 222/94 |
| 3,760,986 | 9/1973 | Castner et al. | 222/137 |
| 3,786,963 | 1/1974 | Metzler, III | 222/136 |
| 4,072,252 | 2/1978 | Steyns et al. | 222/341 |
| 4,161,288 | 7/1979 | McKinney | 239/333 |
| 4,489,861 | 12/1984 | Saito et al. | 222/207 |
| 4,585,150 | 4/1986 | Beacham et al. | 222/129 |
| 5,009,342 | 4/1991 | Lawrence et al. | 222/136 |
| 5,152,461 | 10/1992 | Proctor | 239/304 |
| 5,370,275 | 12/1994 | Mills et al. | 222/136 |
| 5,385,270 | 1/1995 | Cataneo et al. | 222/145.5 |
| 5,398,846 | 3/1995 | Corby et al. | 222/145.5 |

*Primary Examiner*—Andres Kashnikow
*Assistant Examiner*—Philippe Derakshani

[57] ABSTRACT

A spray bottle combination for dispensing fluids from multiple containers, while simultaneously and instantaneously venting the fluid containers. The combination includes at least two fluid containers, a sprayer mechanism, including a sprayer actuator, for pumping fluid from the containers to dispense the fluid, a manifold and a fluid transfer mechanism. One end of the manifold is connected to an outlet end of each of the fluid containers. The manifold provides at least one fluid discharge opening and at least one vent opening for each container. The fluid transfer mechanism provides fluid communication between the fluid discharge openings of the manifold and the sprayer mechanism. The fluid transfer mechanism includes a valve arrangement, engageable with another end of the manifold, for simultaneously opening and closing the fluid discharge openings and air passage to and from the vent openings of the manifold upon a corresponding pumping actuation and deactuation of the sprayer actuator.

21 Claims, 8 Drawing Sheets

ASSEMBLY FOR DISPENSING FLUIDS FROM MULTIPLE CONTAINERS, WHILE SIMULTANEOUSLY AND INSTANTANEOUSLY VENTING THE FLUID CONTAINERS

BACKGROUND OF THE INVENTION

1. Field of the Invention

The present invention relates to the field of fluid dispensers and especially to a leakage resistant fluid dispensing assembly for dispensing fluids from multiple containers, while simultaneously and instantaneously venting the fluid containers. Fluid from multiple containers, which hold the same or different fluids, is ejected or sprayed through a nozzle of the dispensing assembly. The fluids are dispensed by a single pumping and transfer system in a balanced manner from the containers, while the containers are simultaneously vented.

2. Description of the Related Art

It is desirable to simultaneously dispense more than one type of fluid from multiple fluid containers. This is especially true when the fluids to be dispensed contain some active ingredients that are incompatible when these ingredients are mixed together in a single solution, yet it is desired to dispense both fluids with their active ingredients simultaneously. One fluid might be water and the other a concentrate. Or one container might hold a fluid with an active ingredient, which the fluid in the second container would deactivate. Examples of such pairs of fluids could be a cleaning composition and a bleach, or a pair of stain removing compositions, one an aqueous composition and the other a high-solvent level enzyme containing composition. Whatever the pair of fluids, they are intended to be dispensed simultaneously and in a fixed ratio to each other, the ratio being set either by the design of the system itself, as discussed below, or by some sort of flow adjustment means, as is known in the art. This fixed ratio may be 50:50 or 60:40, for example.

Several problems have consistently arisen with dispensing systems of this type. Venting of the containers, without allowing leakage of the fluid contents of a container, has been a consistent and recognized problem. An unaddressed problem with such a dispensing system is achieving and maintaining constant flow rates from the different containers so that the fluids are dispensed in an equal or pre-determinedly different ratio. The result of unequal flow is the exhaustion of one container while another still contains fluid.

As a pump draws fluid from a rigid container, the fluid drawn from that container must be replaced by air (venting) for pumping to continue. By contrast, non-rigid containers simply collapse as fluid is drawn from them. When a single pump draws fluids from two containers simultaneously, and especially when the fluids being pumped from the different containers have different densities or vapor pressures, the degree and speed of venting of the two containers must be almost exactly the same, or a pressure differential is created between the two containers. This is especially true when the differences in densities of the fluids become more distant from each other. This pressure differential causes fluid to be pumped from the two containers at different rates, which tends to exacerbate the pressure differential. It has been found that the "replacement" speed of the venting of the container must be almost instantaneous to avoid the creation of this pressure differential/ratio problem. The result of this problem is that the desired ratio of the two fluids is not dispensed.

An obvious solution to instantaneous venting is simply to have permanently open vent holes into the fluid containers. This, however, is not a functionally acceptable solution for this type of a dispensing system. Such vent holes would also be leak holes. Fluid leakage through open vent holes would occur when such containers are inadvertently inverted or knocked on their sides. Leakage would also occur if such containers were transported in a low-pressure environment (e.g., the cargo section of an airplane). Additionally, permanently open vent holes would allow vaporization of volatile compounds from within a fluid container. Thus, some means of closing the vent holes is necessary, but the closure mechanism must not in any way impede the flow of air into the container when fluids are being dispensed. Also, the closure mechanism should be relatively simple in construction and inexpensive to manufacture.

While consistency of dispensing is controlled by the venting mechanism of the dispensing apparatus, the ratio of the liquids to be mixed and then dispensed is controlled by the intentional balancing of several interrelated factors: the length and diameters of the dip tubes into the fluid containers, the viscosities and specific gravities of the fluids to be dispensed, the rate of pumping and perhaps, the pumping capacity of the pump. The pumping capacity of the pump is dependent upon the diameter of the internal piston or cylinder and the length of the stroke of the pump.

For consistent dispensing of two distinct fluids, excessive commingling of the fluids before they are dispensed must also be prevented. Commingling of the fluids can happen either because the two fluids are brought together in a larger than necessary fluid transfer channel or because a pressure differential created between the containers causes siphoning between the containers. To prevent this, a balanced valving system must be incorporated into the fluid system of the assembly.

Manually operable pumps for use by individuals are necessarily small and lightweight—and therefore have low displacement capacities and low pressure differentials. Available trigger operated spray pumps have been found to pull pressure differentials below approximately 8 psi (550 millibars).

When fluids are dispensed from multiple fluid containers, a small pressure differential can form without unimpeded and instantaneous venting of the containers. This makes venting a critical factor. With larger capacity, higher pressure differential pumps, flapper valves, ball check valves, duck bill valves or the like covering the vent holes would pop open promptly in response to the action of the pump, which created the pressure differential pull. But small pressure differentials mean that small differences in the behavior of the materials or components of a venting system can produce unbalanced venting. For example, deformable materials for use in components of items for mass consumer use are neither precision formulated nor configured. Thus, one flapper valve of a pair might be more or less rigid than the other, and one could flex open in response to a small pressure differential pull before the other, creating unequal venting with the problems described before.

U.S. Pat. No. 5,152,461 (hereinafter referred to as "the '461 patent") to Proctor, "Hand Operated Sprayer With Multiple Fluid Containers" discloses a trigger sprayer dispensing device that selectively draws fluids out from at least two containers, mixes the fluids in a desired concentration or ratio and expels the mixture of fluids out of a nozzle. This trigger sprayer is equipped with a metering device for variably controlling the ratio of fluids being mixed. The containers connected to the trigger sprayer are selectively detachable for refilling a container with fluid or exchanging one of the containers with another container having another fluid.

The '461 patent utilizes a piston and cylinder fluid pumping mechanism, which is located near the nozzle outlet. When the piston draws a vacuum within the cylinder, fluid is drawn up from the first and second bottles, through connecting tubings to the cylinder and out the nozzle. The first and second connecting tubings are made of flexible material so that as the piston reciprocates, the tubings flex back and forth with the piston movement. The piston is provided with a disk-shaped diaphragm installed on its downstream end, which acts as a flapper or butterfly type one-way valve. When at rest, the valve provides positive sealing pressure to inhibit fluid leaking from the chamber back into the bottles, and to inhibit siphoning of fluids between the bottles through the chambers. In the '461 patent, the bottles are individually vented through vent holes having one-way valving mechanisms. The vent holes are provided in tube retainer pieces. Each bottle has its own tube retainer piece, and hence, its own vent hole. To prevent liquid from undesirably leaking out through the vent holes, the venting mechanisms comprise tubular-shaped retainer seals that act as one-way valves. Each bottle likewise has its own retainer seal.

Accordingly, the '461 patent recognizes the need to vent the bottles, but provides a complicated valving arrangement to do so. The dispensing mechanism, with its own separate butterfly-type valve, adds to the complexity of the device in the '461 patent. Such a complex system can be difficult and expensive to manufacture. These costs will be passed on to the consumer. Further, such a complex valving arrangement can fail for one reason or another, for reasons such as those discussed above.

Further, while the '461 patent recognizes the need for venting the bottles, that patent does not recognize the need for instantaneously venting of the bottles upon dispensing of the liquids. Rather, venting is independent for each bottle and a finite or minimum "cracking" pressure is required to open a respective vent hole. Thus, a predeterminedly minimum negative pressure or partial vacuum must be generated in each bottle to open a respective vent hole. With this arrangement, any small differences in the negative pressure necessary to open a respective vent hole will magnify the pressure differentials in dispensing the fluids. This will exacerbate any problems in maintaining a desired dispensing ratio, and can cause premature siphoning of the fluid in one of the containers.

SUMMARY OF THE INVENTION

The present invention has been made in consideration of the above-described problems in the prior art.

It is an object of the present invention to overcome the problems with the prior art discussed above, and to provide an assembly for dispensing fluids from multiple containers, while simultaneously venting the fluid containers. The dispensing assembly of the present invention is relatively simple in design, and hence, to manufacture.

A further object of this invention is to provide such a dispensing system that achieves a stable ratio of dispensing fluids by means of a venting system that allows simultaneous and instantaneous, non-impeded venting of the containers to the ambient atmosphere during pumping of fluid from the containers.

Yet another object of the invention is to provide such a dispensing system that can be transported and stored without danger of leakage or evaporation of its contents.

Still another object of the invention is to provide such a dispensing system that will dispense a mixture of two or more different fluids in a specific and preset ratio.

A further object of the invention is to provide such a dispensing system that will prevent premature commingling or siphoning of the distinct fluids to be dispensed.

To achieve these objects, the present invention, in a first aspect, is directed to an apparatus for dispensing fluids from multiple containers, while simultaneously venting the fluid containers. The apparatus includes at least two containers, each for containing fluid, manually operable pumping means, manifold means, at least one hollow fluid transfer dip tube for each container and valve means. The manually operable pumping means pumps fluid from the containers to dispense the fluid from the apparatus. The pumping means comprises (i) pump actuation means for actuating the pumping means, (ii) a reciprocating fluid conduit, which reciprocates upon actuation of the pump actuation means and (iii) a discharge nozzle for dispensing the fluid from the apparatus. The manifold means is connected to an outlet end of each of the fluid containers and provides at least one fluid discharge opening and at least one vent opening for each container. The hollow fluid transfer dip tubes are connected to a respective fluid discharge opening in the manifold means and extend into a respective fluid container, for withdrawing fluid from the respective container upon actuation of the pumping means. The valve means is connected to the reciprocating fluid conduit of the pumping means and is engageable with the manifold means. The valve means simultaneously and instantaneously opens and closes the fluid discharge openings and the vent openings of the manifold means upon a corresponding pumping actuation and deactuation of the pump actuation means.

To achieve the above-noted objects, the present invention, in a second aspect, is directed to a spray bottle combination. The combination includes at least two fluid discharge bottles, a sprayer mechanism, a manifold and fluid transfer means. The sprayer mechanism includes a sprayer actuator for pumping fluid from the containers to dispense the fluid. The manifold is connected at one end to an outlet end of each of the fluid containers and provides at least one fluid discharge opening and at least one vent opening for each container. The fluid transfer means provides fluid communication between the fluid discharge openings of the manifold and the sprayer mechanism. The fluid transfer means comprises a valve arrangement, engageable with another end of the manifold, for simultaneously and instantaneously opening and closing the fluid discharge openings and the vent openings of the manifold upon a corresponding pumping actuation and deactuation of the sprayer actuator.

The above-noted and other objects, advantages and features of the present invention will become more apparent from the following description of the preferred embodiments taken in conjunction with the accompanying drawings.

BRIEF DESCRIPTION OF THE DRAWINGS

Like reference numerals have been used for like or corresponding elements throughout the views.

DETAILED DESCRIPTION OF THE PREFERRED EMBODIMENTS AND BEST MODE FOR CARRYING OUT THE INVENTION

The preferred embodiments and the best mode for carrying out the invention will now be described with reference to the drawings.

Figure 1:
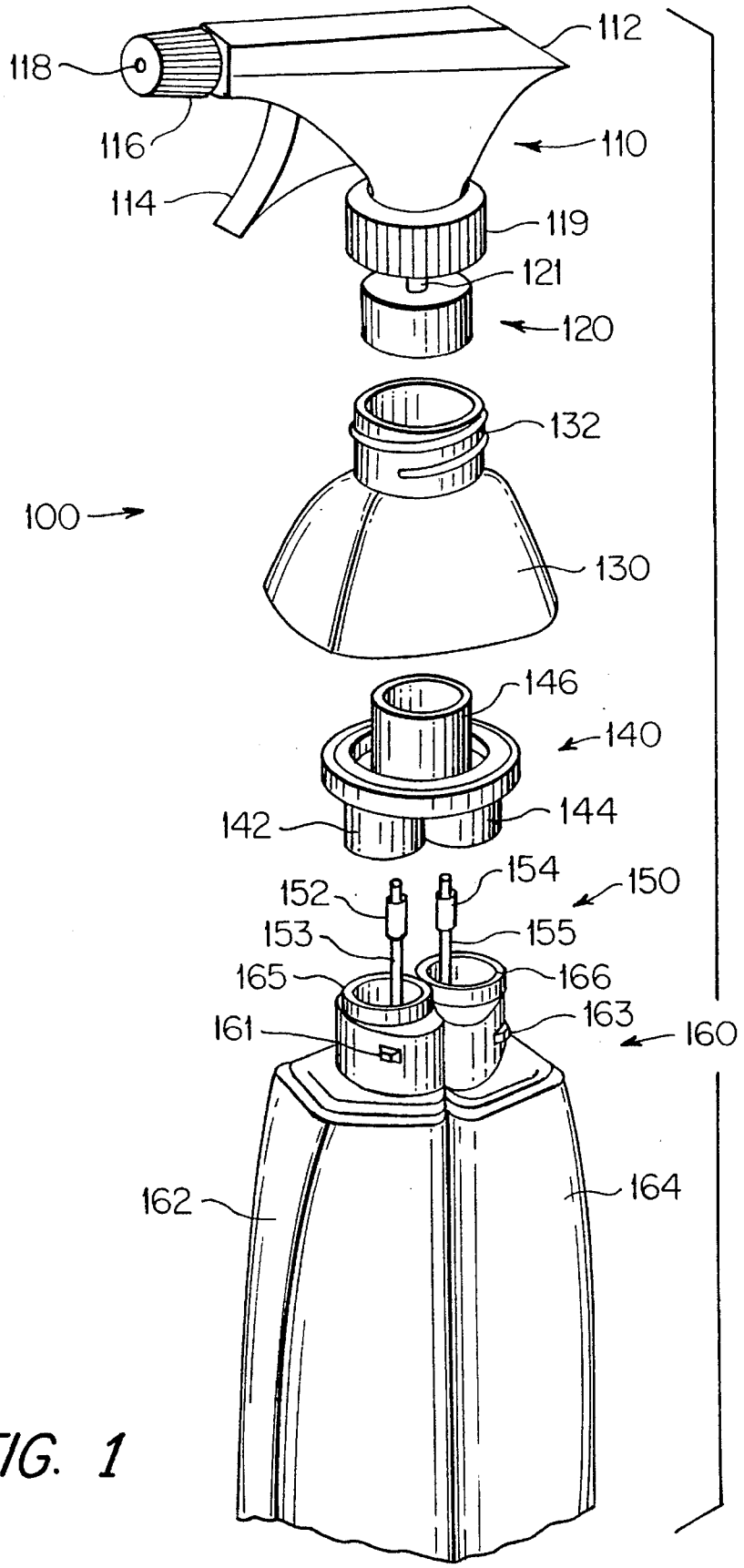
FIG. 1 is an exploded perspective view showing the components of a first embodiment of the dispensing assembly of the present invention.

FIG. 1 shows the overall configuration of the fluid dispensing assembly 100 of a first embodiment of the present invention. Fluid dispensing assembly 100 includes, as main components, a trigger sprayer 110, a valve mechanism 120, a shroud 130, a manifold 140, a dip tube assembly 150 and a fluid container arrangement 160.

The trigger sprayer 110 includes a sprayer head 112, which includes a threaded connector 119 for connecting the trigger sprayer 110 to the shroud 130. The trigger sprayer 110 also includes a trigger 114 which may be manually actuated (squeezed) by a user to dispense fluid out of a nozzle 116 through nozzle opening 118. Trigger sprayer 110 may be any of the manually operated, relatively low displacement types (approximately 0.2 to 1.5 milliliters) available, which utilize a vertically moving or reciprocating conduit or discharge tube. For example, a commercial embodiment of trigger sprayer 110 is available from Owens-Brockway Closure and Specialty Products of North Riverside Ill., as a standard variable spray/low actuation force trigger sprayer. Of course, other trigger sprayers may be used as desired.

In the present invention, then, trigger sprayer 110 is of the reciprocating conduit or discharge tube type in which the conduit or discharge tube is spring loaded.

This means that, in the present invention, actuation and deactivation of trigger 114 will reciprocate spring loaded, reciprocating fluid discharge tube 121, to which valve mechanism 120 is coupled. Operation of the valve mechanism will be discussed later in more detail. Discussion of the operation of the trigger sprayer 110, however, will be limited, since this operation is known in the art.

As is known in the art, reciprocating conduit trigger sprayer 110 utilizes two one-way check valves for dispensing liquids. One valve is provided at the top of the reciprocating fluid discharge tube 121, while the other is located at the end of the fluid discharge conduit (not shown), just upstream of the nozzle 116. Liquid that has already been drawn into the trigger sprayer 110 is dispensed upon actuation (squeezing) of the trigger 114 of trigger sprayer 110, while liquid is drawn into the reciprocating fluid discharge tube 121 upon deactuation of trigger 114, for subsequent discharge upon actuating trigger 114. Such operation will be discussed in more detail below.

FIG. 1 also shows shroud 130, which is provided for aesthetics, as well as for coupling together the elements of the dispenser assembly 100. Shroud 130 includes threads 132 for connection to the threaded connector 119 of trigger sprayer 110. Upon assembly, shroud 130 covers manifold 140. As will be discussed later with respect to other embodiments, shroud 130 can be eliminated if other components perform the same function. Shroud 130 is internally molded or manufactured to mate with manifold 140. In particular, an internal cylindrical wall portion (not shown) of shroud 130 snugly fits over upwardly extending cylindrical portion 146 of manifold 140. Shroud 130 also clips to protrusions 161 and 163 of fluid containers 162 and 164 of the fluid container arrangement 160.

As discussed above, manifold 140 includes upwardly extending cylindrical section 146 to mate with an internal cylindrical wall portion (not shown) of shroud 130. Upwardly extending cylindrical section 146 also is adapted to engage with valve mechanism 120 as will be discussed later. Manifold 140 further includes downwardly extending cylindrical sections 142 and 144, which are adapted to fit into upper openings 165 and 166 of fluid containers 162 and 164, respectively, of fluid container arrangement 160.

Fluid containers 162 and 164 are separate, but interlocking. This type of arrangement is known in the art. For example, these fluid containers may be plastic bottles having identical shell configurations. The shells are generally round or cylindrical with one side being flat. These flat sides have grooves and protrusions, for example, to mate together. Fluid container 162 may, for example, be filled with a fluid, such as a concentrated household cleaning fluid, and fluid container 164 may, for example, be filled with a diluting fluid, such as water. The fluid dispensing assembly 100 then meters out a mixture of the cleaning fluid diluted with water. This mixture will be at a desired or substantially fixed ratio such as 50:50 or 60:40, for example. The user will refill the fluid containers, as necessary. Of course, the present invention is not limited to these examples, for any type of fluids, whether used alone or to be mixed in any ratio, may be used as desired.

Dip tubes 153 and 155 are respectively affixed to the downwardly extending cylindrical projections 142 and 144 of the manifold 140 by optional dip tube connectors 152 and 154, respectively. Dip tubes 153 and 155 are respectively inserted into fluid containers 162 and 164 for drawing liquid from those containers.

Dip tube connectors 152 and 154 may be eliminated if not required in a particular installation, in which case, the dip tubes are connected directly to the manifold 140. However, dip tube connectors 152 and 154 also provide a convenient location for installing one-way check valves, which may be required to prevent commingling of the liquids. For example, ball check valves, duck bill valves or other one-way valves, known in the art, could be utilized, if desired, for this purpose. This option for providing one-way valves is true for this embodiment, as well as those discussed below.

The materials of construction of the foregoing elements depend in part upon the type of fluids being dispensed. For example, in an application where one fluid container is filled with a high concentration cleaning fluid and another fluid container is filled with water as a diluting fluid, certain materials may be preferred. For example, the elements contacting either the cleaning fluid or water may be water and solvent resistant materials selected from the group consisting of polyethylene, polypropylene, polyethylene terephthalate (PET) and polyvinyl chloride (PVC).

When the components discussed above are assembled, the fluid dispensing assembly 100 is substantially leak proof, and provides an arrangement for carrying and transporting fluids contained within the fluid containers 162 and 164. Since the connection between the elements of fluid dispensing assembly 100 is airtight, air is generally unable to enter the bottles, unless and until the valve mechanism is actuated. As will be discussed below, valve mechanism 120 simultaneously and instantaneously opens and closes the vent openings and fluid dispensing openings in the manifold 140 upon a corresponding actuation and deactuation of the trigger sprayer 110.

When trigger 114 is actuated to dispense liquid, reciprocating fluid conduit (discharge tube) 121 will move upwardly, and hence, will also move valve mechanism 120 upwardly. Therefore, upward movement of the fluid conduit 121 correspondingly moves valve mechanism 120 upwards, which simultaneously opens the fluid dispensing openings and the vent openings in the manifold 140, as will be discussed in more detail below. When trigger 114 is deactuated, to refill the trigger sprayer 110, reciprocating fluid conduit 121 will move downwardly, moving valve mechanism 120 downwardly, to draw a vacuum within the dispensing assembly 100. Fluid is then drawn up from both the first fluid container 162 and the second fluid container 164. Fluid from the first fluid container 162 passes through respective dip tube 153 while fluid from the second fluid container 164 passes through respective dip tube 155. By this dispensing operation, fluid is drawn through manifold 140 and reciprocating fluid conduit 121 and dispensed through nozzle opening 118, while fluid containers 162 and 164 are simultaneously vented to the atmosphere. This venting also is instantaneous with a dispensing operation.

Figure 2:
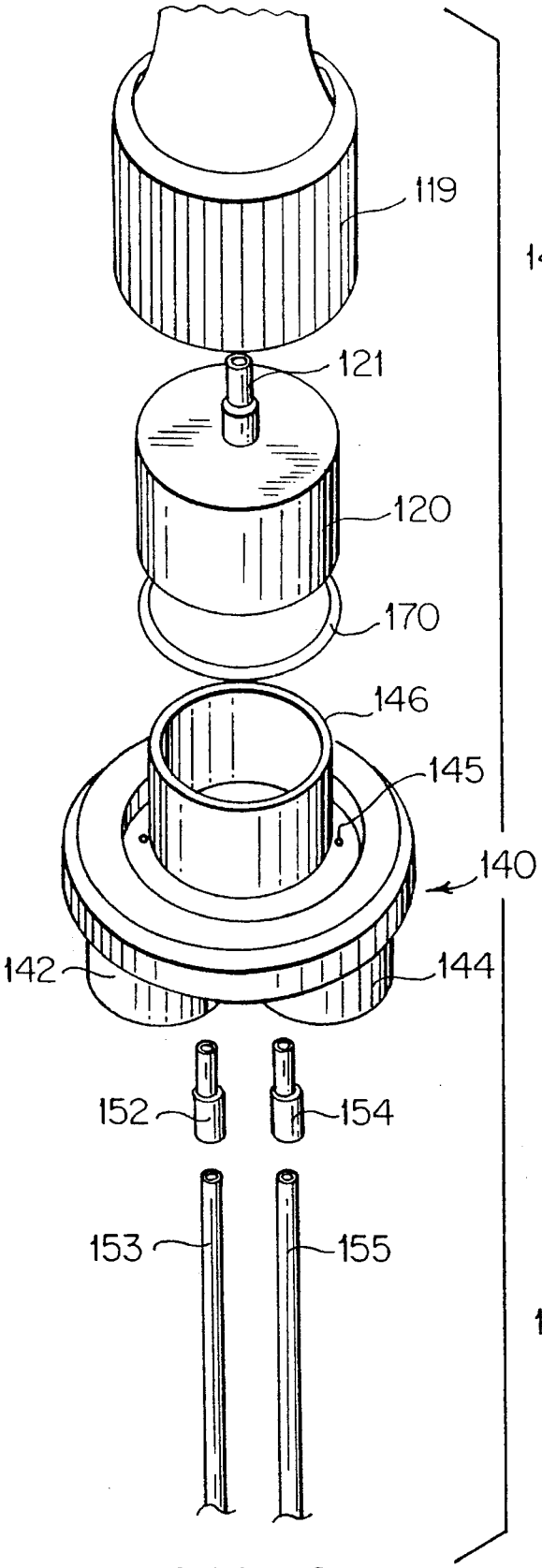
FIG. 2 is an exploded perspective view showing the major components of the manifold and valve assembly of the first embodiment.

FIG. 2 shows in more detail the relationship between the valve mechanism 120 and the manifold 140 in the first embodiment of the present invention. Shroud 130 is not shown in FIG. 2. As shown, however, valve mechanism 120 is connected directly to reciprocating conduit 121 of the sprayer head 112.

FIG. 2 also shows in more detail the upwardly extending cylindrical portion 146 of manifold 140, which is adapted to engage valve mechanism 120. Also shown are downwardly extending cylindrical sections 142 and 144 to which either optional dip tube connectors 152 and 154 or dip tubes 153 and 155 are respectively attached in a suitable manner. For example, these members may be force fit. Alternatively, they could be attached by gluing or otherwise adhesively securing, spot welding, molding or otherwise so as to provide an equivalent structure.

Also shown in FIG. 2 is an optional O-ring 170, which can fit over upwardly extending cylindrical portion 146 of manifold 140 to assist in the seating of the valve mechanism 120 to the manifold 140. Further shown are vent openings 145 in manifold 140, which will be discussed below with respect to FIGS. 3 through 5C.

Figure 3:
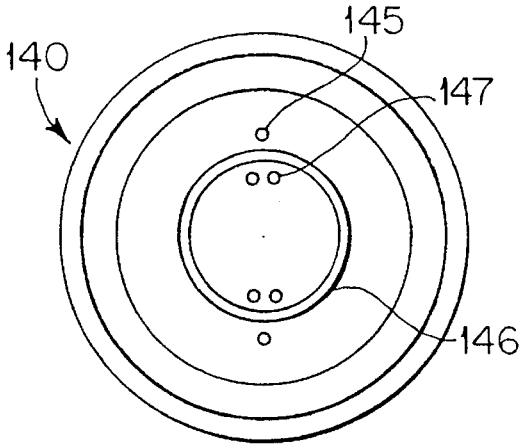
FIG. 3 is a top view of the manifold of the first embodiment, showing the fluid dispensing and vent openings.

FIG. 3 is a top view of manifold 140 of the first embodiment and shows upwardly extending cylindrical portion 146, as well as vent openings 145 and fluid dispensing openings 147. Vent openings 145 allow the fluid containers 162 and 164 to be vented to the atmosphere when valve mechanism 120 is moved upwardly by upward movement of reciprocating conduit 121, upon actuation of the trigger 114 of the sprayer head 112.

Figure 4:
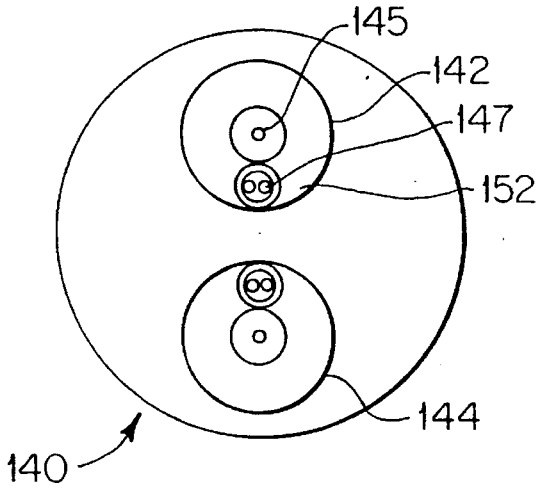
FIG. 4 is a bottom view of the manifold of the first embodiment, showing the dip tube connection to the manifold, and the fluid dispensing and vent openings.

FIG. 4 is a bottom view of the manifold 140 of the first embodiment. FIG. 4 shows downwardly extending cylindrical members 142 and 144. Also shown are vent openings 145, as well as fluid dispensing openings 147. As is representative, optional dip tube connector 152 can be affixed to the downwardly extending cylindrical member 142. Of course, if the dip tube connectors are not utilized, then the dip tubes are connected directly to the downwardly extending cylindrical members of manifold 140. As discussed above, fluid is drawn upwardly through fluid dispensing openings 147 when valve mechanism 120 is moved downwardly by downward movement of reciprocating conduit 121, upon deactuation of trigger 114.

Figures 5A, 5B, 5C:
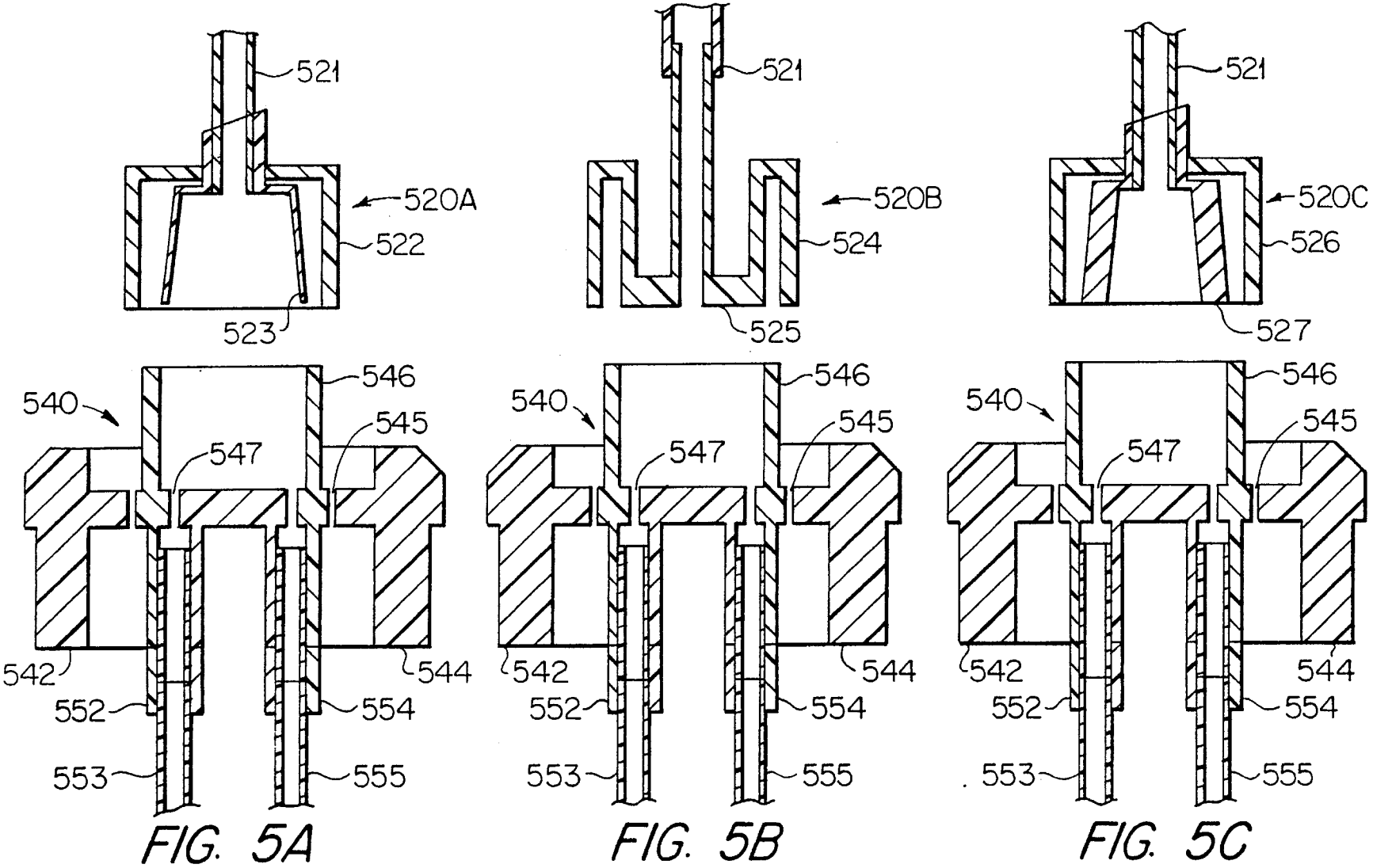
FIG. 5A is an exploded view, in cross section, showing the relationship between the valve mechanism and manifold in the first embodiment.
FIG. 5B is an exploded view, in cross section, showing the relationship between the valve mechanism and manifold in a first variation of the first embodiment.
FIG. 5C is an exploded view, in cross section, showing the relationship between the valve mechanism and manifold in a second variation of the first embodiment.

FIG. 5A shows the relationship between the valve mechanism 520A and manifold 540 in the first embodiment. Valve mechanism 520A includes first and second concentric cylinders 522 and 523 nested together with a gap therebetween. In this specific embodiment, inner concentric "cylinder" 523 is shown as being substantially frustoconical. Of course, this "cylinder" may be made of any shape that performs the functions discussed below. For ease of discussion, then, this member will be referred to as being cylindrical. Each concentric cylinder has an open end and a closed end. The closed end of each concentric cylinder is attached to the reciprocating conduit 521. The outer one 522 of the first and second concentric cylinders opens and closes the vent openings 545 of manifold 540 upon a corresponding pumping actuation and deactuation of the sprayer head 112. In this embodiment, the inner one 523 of the first and second concentric cylinders acts as a guide for guiding the valve mechanism 520A along the upwardly extending cylindrical member 546 of the manifold 540.

Upwardly extending cylindrical member 546 creates a mixing chamber for fluid, which is drawn from the bottles 162 and 164 upon downward movement of valve mechanism 520A upon deactuation of trigger 114 of sprayer head 112. As discussed above, fluid is dispensed upon actuation of trigger 114. In this embodiment and the variations discussed below, it is preferable that the internal diameter of upwardly extending cylindrical member 546, which partially forms the mixing chamber, be less than or equal to the internal volume or diameter of the reciprocating piston, in order to prevent backflow.

In this embodiment, fluid flow ceases upon complete deactuation of trigger 114 of sprayer head 112, which, as discussed above, has its own internal valve mechanism. Therefore, it is not necessary for the inner cylinder 523 of the valve mechanism 520 to close the fluid dispensing openings 547, in this embodiment. Rather, this inner cylinder merely acts as a guide for guiding the outer concentric cylinder 522 of valve mechanism 520. Nevertheless, this embodiment provides for the dispensing of liquid and simultaneous venting of the fluid containers. As in the discussion above, dip tubes 553 and 555 are respectively connected to optional dip tube connectors 552 and 554, which are in turn connected to downwardly extending cylindrical members 542 and 544 of manifold 540. These dip tubes supply liquid to sprayer head 112.

In this embodiment, it is suggested that dip tube connectors 552 and 554 be provided with respective one-way valving (not shown) such as ball, butterfly, flapper, duck bill or other types of one-way check valves. This will prevent commingling of fluids that would otherwise return from the above-noted mixing chamber. As discussed above, such valving is known in the art.

In this embodiment, and the variations discussed below, it is preferred that the valve mechanism and the manifold be made of dissimilar materials. It has been found that this improves performance. For example, the valve mechanism may be made of polyethylene and the manifold of polypropylene. In particular, the valve may be made of medium density polyethylene, while the manifold may be made of Delran (a registered trademark of E. I. DuPont de Nemours Co.). However, it is not necessary to use these specific materials. Rather, any other suitable materials may be used as long as they provide the desired effect. Further, these elements could be made of the same material or these materials could be reversed, if circumstances warrant.

FIG. 5B shows the relationship between valve mechanism 520B and manifold 540 in a first variation of the first embodiment. In this variation and in the second variation shown in FIG. 5C, the valve mechanisms in these variations simultaneously open and close the fluid dispensing openings, as well as the vent openings.

As shown in FIG. 5B, valve arrangement 520B comprises a unitary member connected to the reciprocating fluid conduit 521 for simultaneously opening and closing the fluid discharge openings 547 and the vent openings 545 of the manifold 540. Valve mechanism 520B acts independently of any valve mechanism in the sprayer head 112. Outer portion 524 of valve mechanism 520B opens and closes vent openings 545, while inner portion 525 opens and closes fluid dispensing openings 547, in manifold 540. Thus, this variation provides a simple, yet effective device for simultaneously opening and closing the fluid dispensing openings 547 and the vent openings 545. This venting also is instantaneous with a dispensing operation. The remaining elements in FIG. 5B are the same as those shown in FIG. 5A.

In this variation, it is preferred to mold or otherwise manufacture valve mechanism 520B as a unitary member from plastic. This optimizes the tolerances between the valve mechanism 520B and manifold 540. However, it is not necessary that valve mechanism 520B be of unitary construction. Rather, this mechanism could be manufactured as discrete components, and assembled. Though cumbersome and expensive, this would nevertheless be effective. For reasons such as these, it is preferred to minimize manufacturing expenses and to make the valve mechanism 520B of unitary construction.

FIG. 5C shows the relationship between valve mechanism 520C and manifold 540 in a second variation of the first embodiment. In this variation, valve mechanism 520C includes first and second concentric cylinders 526 and 527 nested together with a gap therebetween. As in the embodiment shown in FIG. 5A, inner concentric "cylinder" 527 is shown as being frustoconical. Nevertheless, for ease of discussion, this member is referred to as being cylindrical, since many configurations are suitable. Each concentric cylinder has an open end and a closed end. The closed end of each concentric cylinder is attached to the reciprocating conduit 521. These concentric cylinders should be arranged with minimal "play" therebetween. This enhances operation. The outer one 526 of the first and second concentric cylinders opens and closes the vent openings 545 of manifold 540 upon a corresponding pumping actuation and deactuation of the sprayer head 112. The inner one 527 of the first and second concentric cylinders opens and closes the fluid dispensing openings 547 of manifold 540 upon a corresponding pumping actuation and deactuation of the sprayer head 112.

Valve mechanism 520C acts independently of any valve mechanism in sprayer head 112, to simultaneously open and close the fluid dispensing openings 547 and the vent openings 545. Thus, this variation also provides a simple, yet effective device for simultaneously opening and closing the fluid dispensing openings 547 and the vent openings 545. This venting also is instantaneous with a dispensing operation. The remaining elements in FIG. 5C are the same as those shown in FIGS. 5A and 5B.

Figure 6:
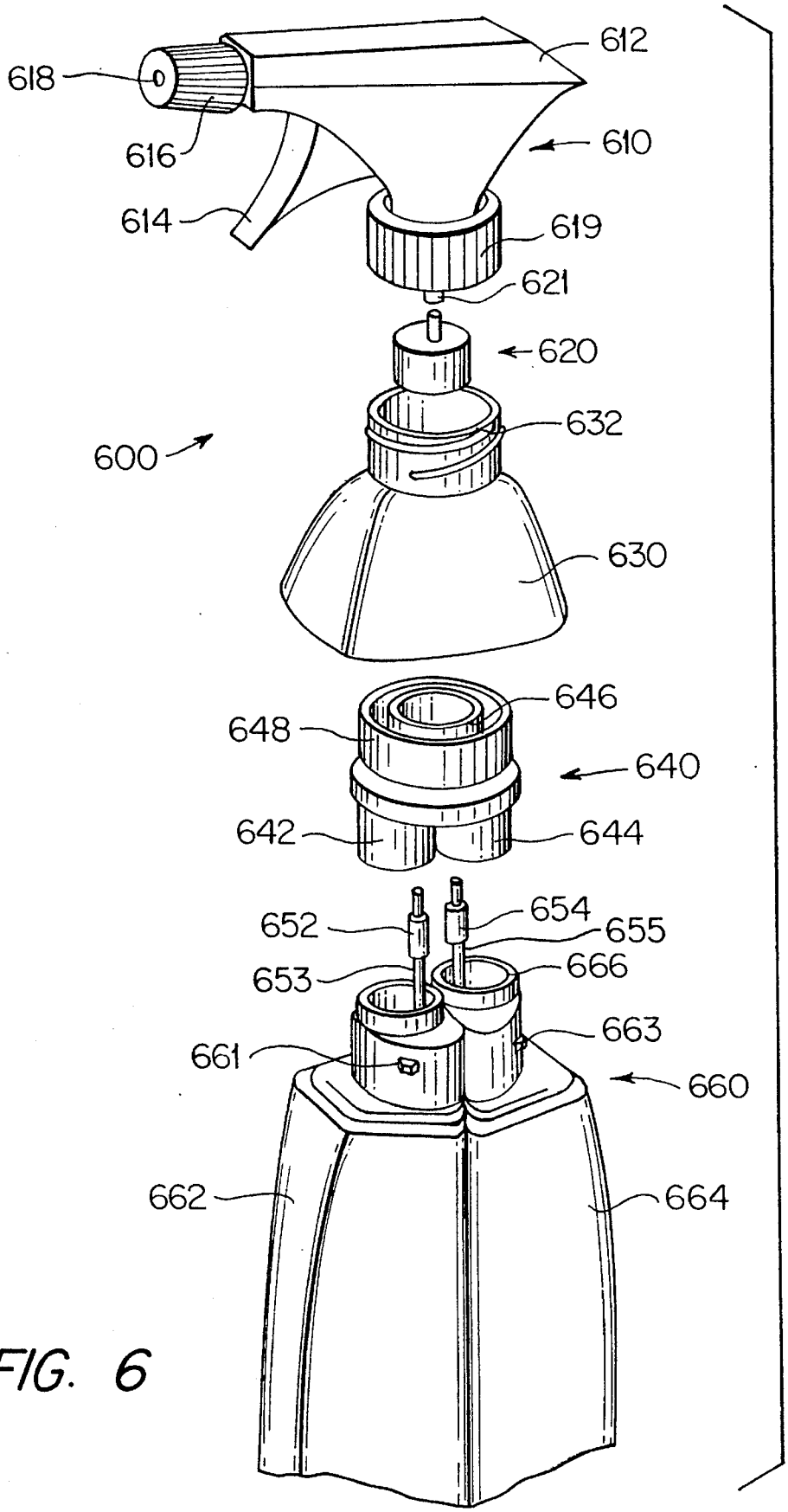
FIG. 6 is an exploded perspective view showing the components of a second embodiment of the dispensing assembly of the present invention.

FIG. 6 shows dispensing assembly 600 in a second embodiment of the present invention. The essential differences between the dispensing assembly 600 of the second embodiment and the dispensing assembly 100 of the first embodiment are in the valve mechanism 620 and the manifold 640. Therefore, discussion will be limited to these features.

Figure 7:
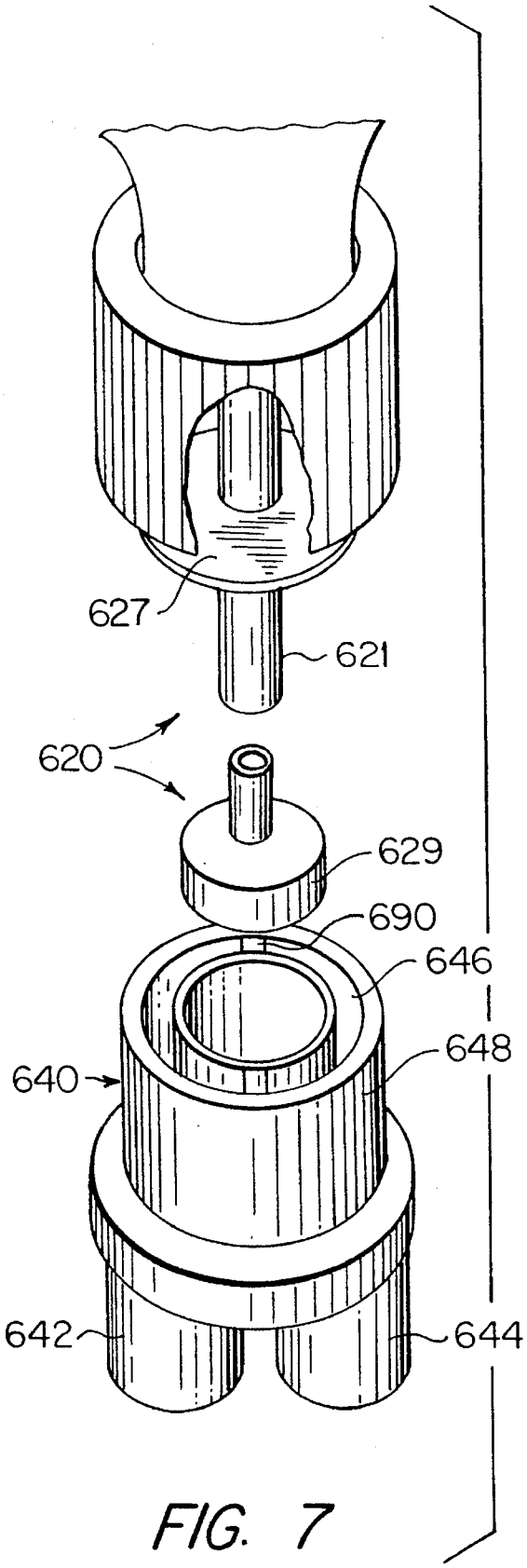
FIG. 7 is an exploded perspective view showing the major components of the manifold and valve assembly of the second embodiment.

FIG. 7 best shows the relationship between valve mechanism 620 and manifold 640 of dispensing assembly 600 in the second embodiment. (Shroud 630 and dip tubes 653 and 655 have been omitted in this view, for simplicity.) Valve mechanism 620 includes a first valve member 627, generally having a washer shape, which is affixed to an intermediate position of the reciprocating fluid conduit 621. Valve mechanism 620 also includes a second valve member 629, which is affixed to an end of the reciprocating fluid conduit 621.

The first valve member 627 opens and closes the vent openings of the manifold 640, while the second valve member 629 simultaneously opens and closes the fluid discharge openings of the manifold 640. In this embodiment, manifold 640 includes a first upwardly extending cylindrical member 646 and a second upwardly extending cylindrical member 648. These members are generally concentric cylindrical members with a gap therebetween. This gap acts as a vent channel, which is opened and closed by the first valve member 627.

Also provided is a dam 690, which prevents commingling of the fluids. Alternatively, the gap between the concentric cylindrical members could be closed up, with the exception of one or more vent holes for each of the fluid bottles. This variation is not shown in the drawings.

Figure 8:
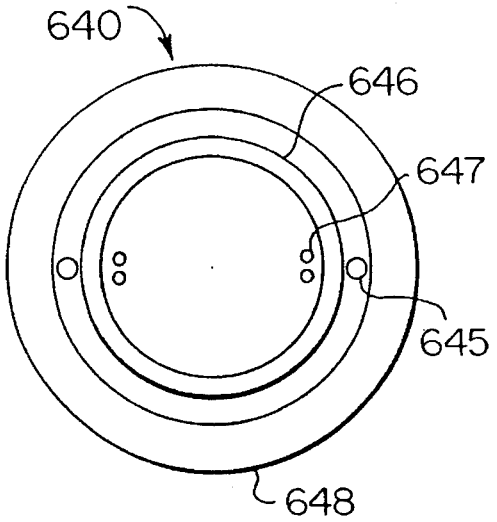
FIG. 8 is a top view of the manifold of the second embodiment, showing the fluid dispensing and vent openings.
Figure 9:
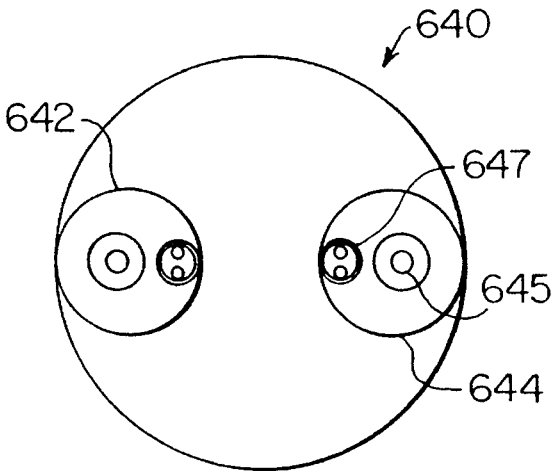
FIG. 9 is a bottom view of the manifold of the second embodiment, showing the dip tube connection to the manifold, and the fluid dispensing and vent openings.

FIGS. 8 and 9 are top and bottom views of manifold 640, respectively. These views substantially correspond to those shown in FIGS. 3 and 4, respectively. Therefore, discussion of the elements shown in those views will not be repeated.

Figure 10A:
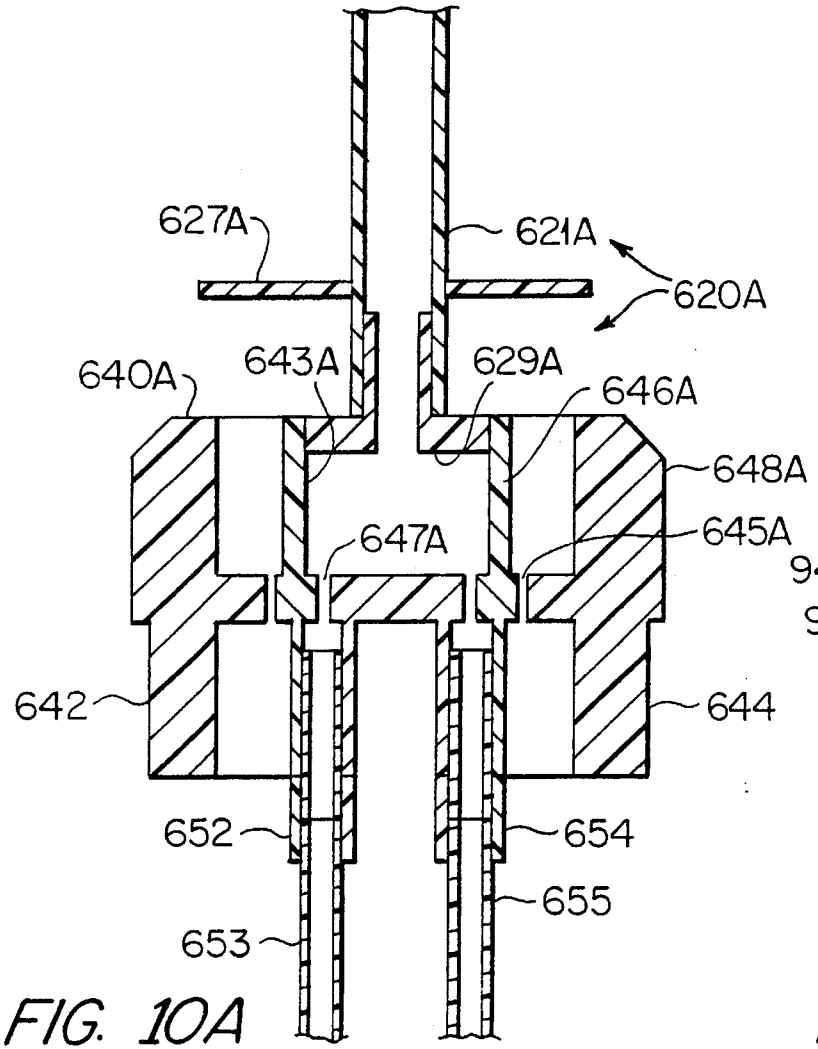
FIGS. 10A and 10B are a cross-sectional views showing the relationship between the manifold and valve mechanism in first and second variations of the second embodiment.

FIG. 10A shows the relationship between valve mechanism 620A and manifold 640A in a first variation of the second embodiment. In this embodiment, valve mechanism 620A simultaneously opens and closes the fluid dispensing openings 647A, as well as air passage to and from the vent openings 645A.

In the embodiment shown in FIG. 10A, first valve member 627A, generally having a washer shape, is affixed to an intermediate position of the reciprocating fluid conduit 621A. The second valve member 629A is affixed to an end of the reciprocating fluid conduit 621A. Valve mechanism 620A acts independently of any valve mechanism in the sprayer head 612. As shown in FIG. 10A, the first valve member 627A opens and closes air passage to and from the vent openings 645A of the manifold 640A, while the second valve member 629A simultaneously opens and closes the fluid discharge openings 647A of the manifold 640A.

The first valve member 627A acts as a cap to close off the top of manifold 640A. The second valve member 629A is guided along the inside portion 643A of upwardly extending inner cylindrical member 646A of manifold 640A. First valve member 627A and second valve member 629A operate together, and in response to a corresponding movement of reciprocating fluid conduit 621A. When trigger 614 is squeezed to dispense fluid, first valve member 627A and second valve member 629A will instantaneously and simultaneously open their respective passages and openings, in a corresponding upward movement of reciprocating fluid conduit 621A. Likewise, these valve members will simultaneously and instantaneously close their corresponding passages and openings when trigger 614 is deactuated. Thus, this embodiment also provides a simple, yet effective device for simultaneously and instantaneously opening and closing the fluid dispensing openings 647A and air passage to and from the vent openings 645A.

Figure 10B:
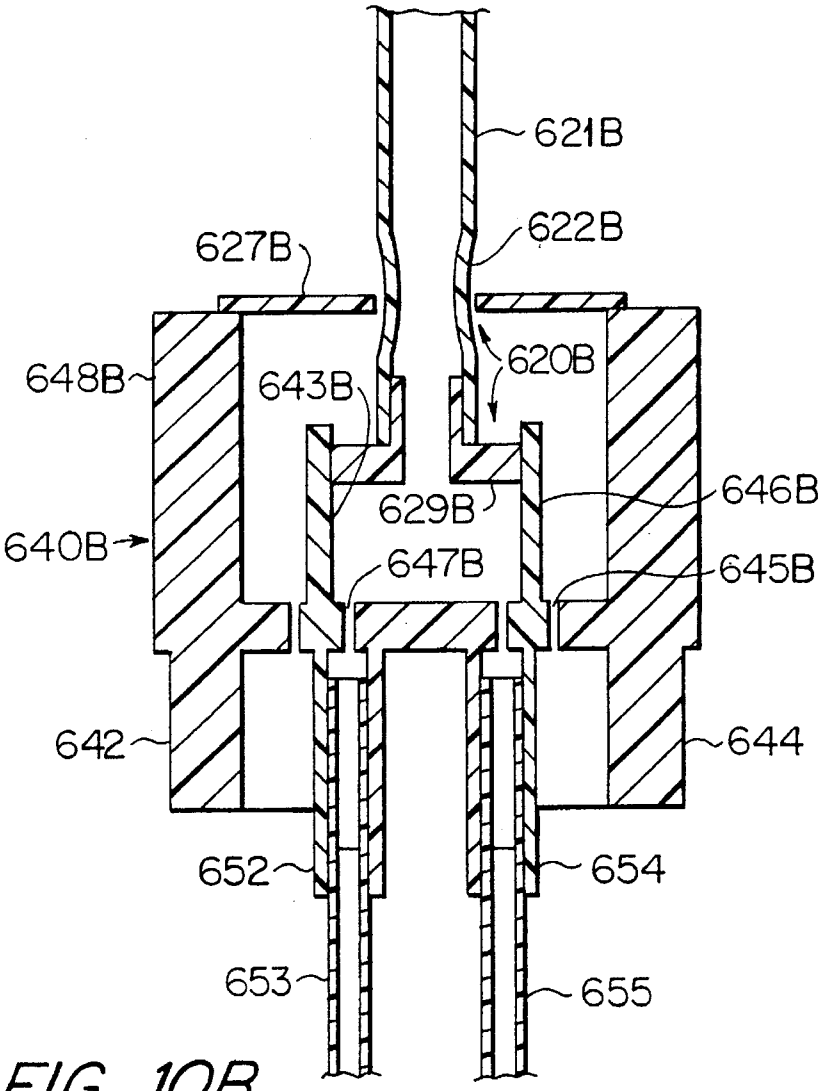

FIG. 10B shows the relationship between valve mechanism 620B and manifold 640B in a second variation of the second embodiment. In this embodiment, as well, valve mechanism 620B simultaneously opens and closes the fluid dispensing openings 647B, as well as air passage to and from the vent openings 645B.

In the embodiment shown in FIG. 10B, first valve member 627B, generally having a washer shape, is affixed to upwardly extending outer cylindrical member 648B of the manifold 640B. As shown in FIG. 10B, reciprocating fluid conduit 621B includes a tapered portion 622B, which cooperates with first valve member 627B to open and close air passage to and from the vent openings 645B. In FIG. 10B, this tapered portion 622B is shown as being arcuate. However, other configurations could be equally effective. For example, a plug-shape or other angular geometric configurations could be used as desired.

The second valve member 629B is affixed to an end of the reciprocating fluid conduit 621B. As before, valve mechanism 620B acts independently of any valve mechanism in the sprayer head 612.

FIG. 10B shows an "open" position, in which the trigger 614 is in the actuated position. In this configuration, first valve member 627B allows air to pass between tapered portion 622B of reciprocating conduit 621B and first valve member 627B in order to vent the bottles. Also, second valve member 629B allows fluid to be drawn from the bottles through fluid dispensing openings 647B.

Accordingly, in the variation shown in FIG. 10B, the first valve member 627B, in cooperation with reciprocating conduit 621B, opens and closes air passage to vent openings 645B of the manifold 640B, while the second valve member 629B simultaneously opens and closes the fluid discharge openings 647B of the manifold 640B. The second valve member 629B is guided along the inside portion 643B of upwardly extending inner cylindrical member 646B of manifold 640B. First valve member 627B and second valve member 629B operate together, and in response to a corresponding movement of reciprocating fluid conduit 621B. When trigger 614 is squeezed to dispense fluid, first valve member 627B and second valve member 629B will instantaneously and simultaneously open their respective passages and openings, in a corresponding upward movement of reciprocating fluid conduit 621B. Likewise, these valve members will simultaneously and instantaneously close their corresponding passages and openings when trigger 614 is deactuated. Thus, this embodiment also provides a simple, yet effective device for simultaneously and instantaneously opening and closing the fluid dispensing opens 647B and air passage to and from the vent openings 645B.

As discussed above with respect to FIG. 7, suitable damming devices can be provided in the embodiment of FIG. 10B, to prevent commingling of fluids. Also, a stop member could be provided, if desired, to further limit upward movement of reciprocating fluid conduit 621B. For example, stops could be provided on upwardly extending inner cylindrical member 646B of manifold 640B.

Although not shown, other configurations of first valve member 627B and second valve member 629B could be designed, within the concepts of the present invention. Any equivalent structure that performs the same valving functions can be used as desired. Therefore, the present invention should not be limited to these embodiments.

Figure 11:
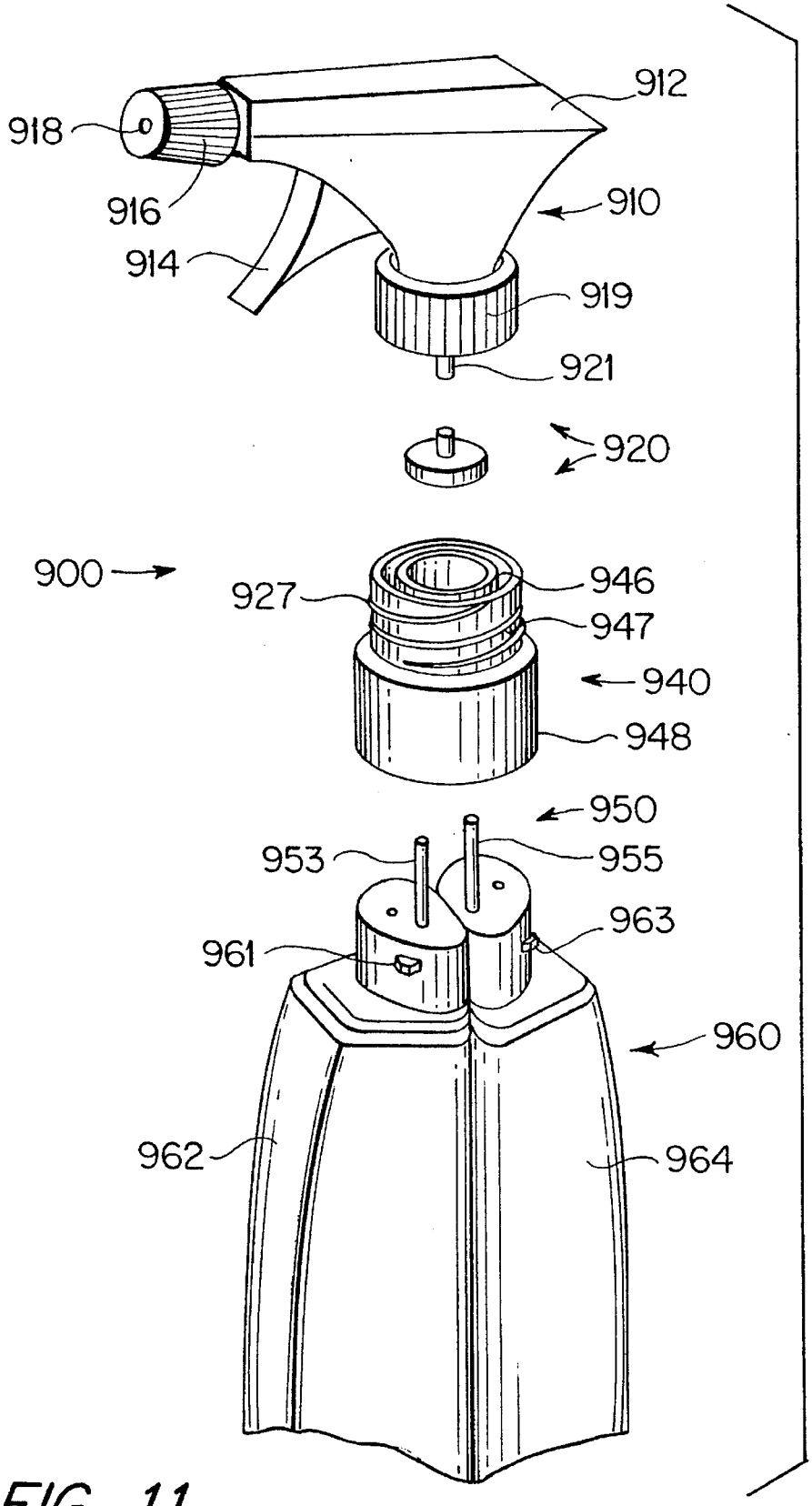
FIG. 11 is an exploded perspective view showing the components of a third embodiment of the dispensing assembly of the present invention.

FIG. 11 shows dispensing assembly 900 in a third embodiment of the present invention. The essential differences between the dispensing assembly 900 of the third embodiment and the dispensing assembly 600 of the second embodiment is that the third embodiment does not utilize any shroud member. Rather, manifold 940 has been modified to include the features of any shroud member. Also, in the third embodiment, the fluid containers have been modified to include previously formed dip tubes. Specifically, the tops of these containers are closed, with the exception of the dip tubes.

In this embodiment, manifold 940 includes an upwardly extending inner cylindrical member 946 and an upwardly extending outer cylindrical member 947, which includes threads 927 for connection to threaded connector 919 of sprayer head 912. Manifold 940 also includes a bottom portion 948 that is adapted to be secured directly to fluid dispensing containers 962 and 964.

Figure 12A:
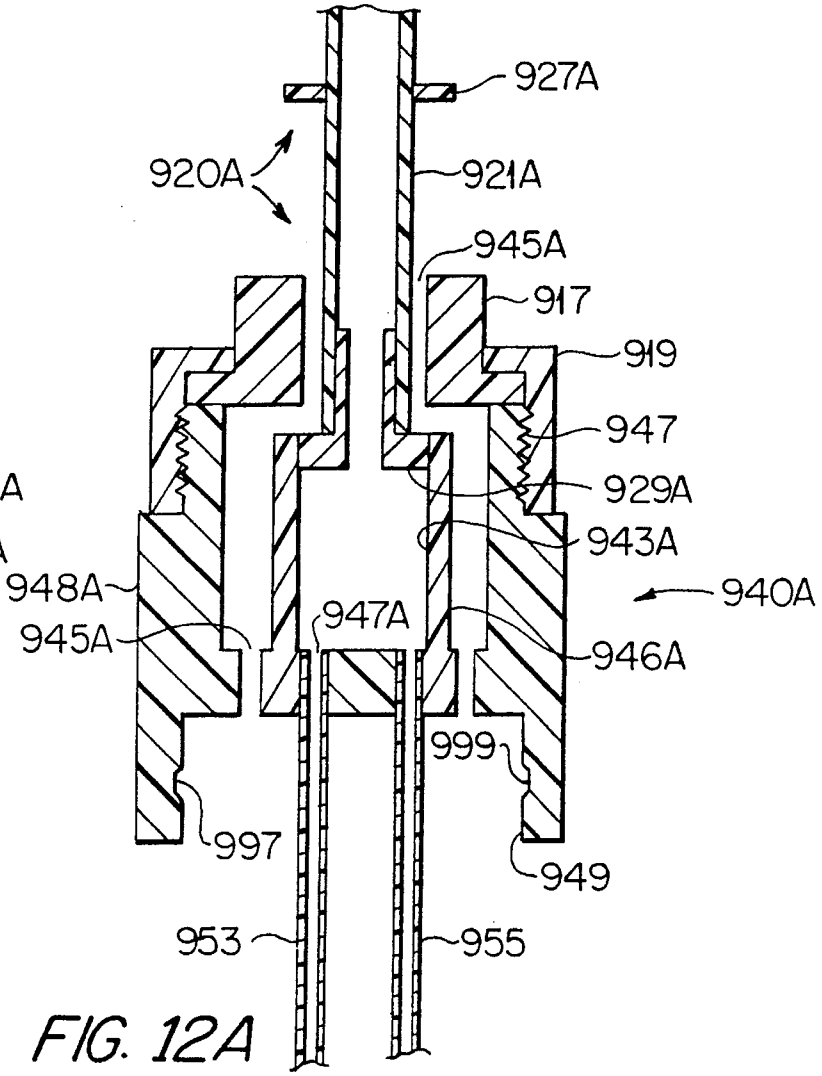
FIGS. 12A and 12B are a cross-sectional views showing the relationship between the manifold and the valve mechanism in first and second variations of the third embodiment.

FIG. 12A is a cross-sectional view showing the relationship between manifold 940A and valve mechanism 920A in a first variation of the third embodiment. As discussed above with respect to FIG. 11, threaded connection 919 of sprayer head 912 is secured directly to manifold 940A by threads 947. Sprayer head 912 also includes an optional L-shaped flange portion 917 for modifying the vent passage.

In this embodiment, manifold 940A is configured to receive dip tubes 953 and 955. As discussed above, these dip tubes are integrally formed into their respective fluid containers. Manifold 940 further includes recesses 997 and 999 for receiving respective protrusions 961 and 963 of fluid containers 962 and 964.

In this embodiment, valve mechanism 920A includes a first valve member 927A, generally having a washer shape, affixed to an intermediate position of reciprocating fluid conduit 921A. If flange portion 917 is not utilized, first valve member 927A can be extended as necessary (see, for example, first valve member 627A shown in FIG. 10A.) Valve mechanism 920A further includes a second valve member 929A, which is affixed to an end of the reciprocating fluid conduit 921A. Second valve member 929 is adapted to fit within inner portion 943A of upwardly extending inner cylindrical member 946A of manifold 940A. First valve member 927A and second valve member 929A operate together, and in response to a corresponding movement of reciprocating fluid conduit 921A. The first valve member 927A opens and closes the air passage to and from vent openings 945A of manifold 940A, while the second valve member 929A opens and closes the fluid discharge openings 947A of manifold 940A.

Valve mechanism 920A acts independently of any valve mechanism in sprayer head 912, to simultaneously open and close the fluid dispensing openings 947A and the vent openings 945A. Thus, this embodiment also provides a simple, yet effective device for simultaneously and instantaneously opening and closing the fluid dispensing openings 947A and air passage to and from the vent openings 945A.

Figure 12B:
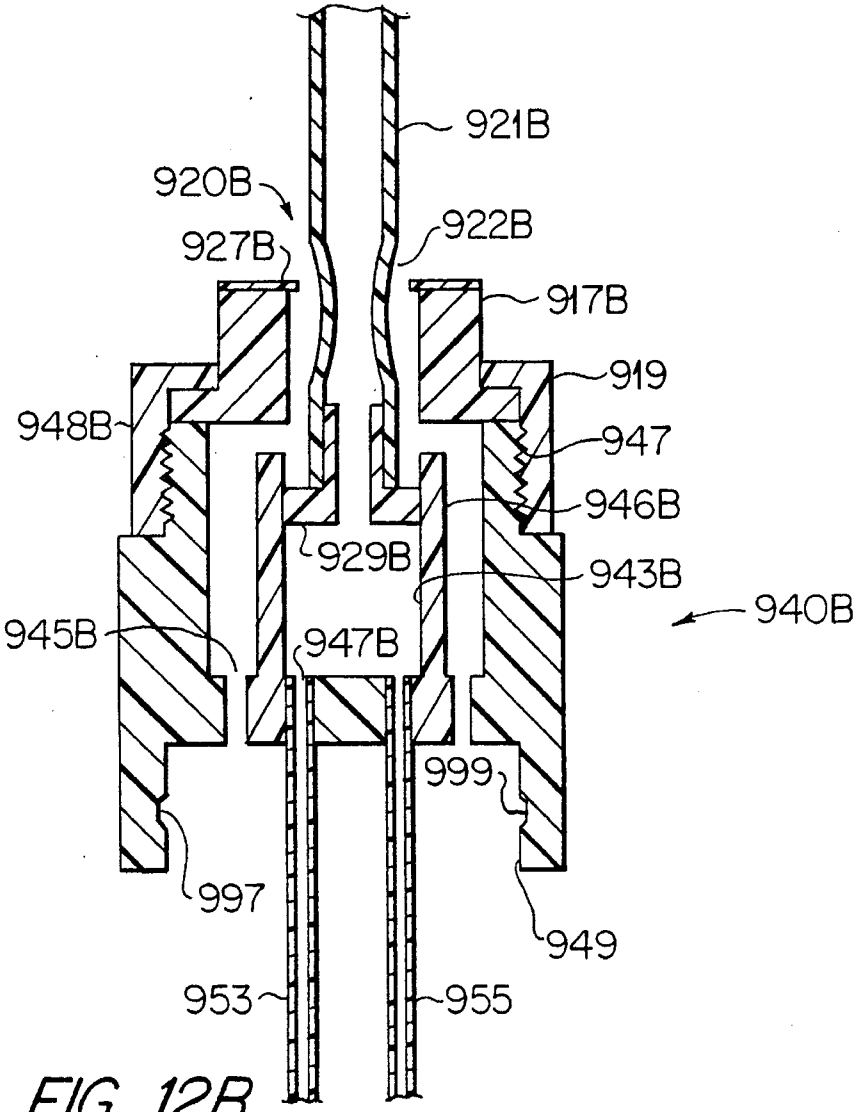

FIG. 12B is a cross-sectional view showing the relationship between manifold 940B and valve mechanism 920B in a second variation of the third embodiment. As discussed above, threaded connection 919 of sprayer head 912 is secured directly to manifold 940B by threads 947. Sprayer head 912 also includes an optional L-shaped flange portion 917B for modifying the vent passage. As shown in FIG. 12B, L-shaped flange portion 917B also includes an extension which, in conjunction with tapered portion 922B of reciprocating fluid conduit 921B, constitutes valve mechanism 927B, which will be discussed below.

In this embodiment, valve mechanism 920B includes a first valve member 927B, generally having a washer shape, affixed to the flange portion 917B of the sprayer head 912. If flange portion 917B is not utilized, first valve member 927B can be provided directly to upwardly extending outer cylindrical member 948B of the manifold 940B.

In this embodiment, reciprocating fluid conduit 921B has been modified to include a tapered portion 922B. Tapered portion 922B cooperates with first valve member 927B to open and close the vent passages in order to allow air to enter and exit vent openings 945B.

Valve mechanism 920B further includes a second valve member 929B, which is affixed to an end of the reciprocating fluid conduit 921B. Second valve member 929B is adapted to fit within inner portion 943B of upwardly extending inner cylindrical member 946B of manifold 940B. First valve member 927B and second valve member 929B operate together, and in response to a corresponding movement of reciprocating fluid conduit 921B. The first valve member 927B opens and closes the vent passages of manifold 940B, while the second valve member 929B simultaneously opens and closes the fluid discharge openings 947B of manifold 940B.

Valve mechanism 920B acts independently of any valve mechanism in sprayer head 912, to simultaneously open and close the fluid dispensing openings 947B and the vent openings 945B. Thus, this embodiment also provides a simple, yet effective device for simultaneously and instantaneously opening and closing the fluid dispensing openings 947B and air passage to and from the vent openings 945B.

Preferred embodiments for providing an assembly for dispensing fluids from multiple containers, while simultaneously venting the fluid containers, have been discussed above. The present invention overcomes those drawbacks associated with the prior art, and provides such a dispensing system that achieves a stable ratio of dispensing fluids by means of a venting system that allows simultaneous and instantaneous, non-impeded venting of the containers to the atmosphere during pumping of fluid from the containers. The present invention also provides such a dispensing system that can be transported and stored without danger of leakage or evaporation of its contents, one that will dispense a mixture of two or more fluids in a specific and preset ratio and one that will prevent premature commingling or syphoning of the distinct fluids to be dispensed.

The present invention has been discussed with respect to a "dual bottle" assembly. However, the present invention is not limited to this configuration. Rather, the valve mechanism and manifold arrangement of the present invention can be utilized with single or multiple (two or more) fluid container arrangements. Also, as discussed above, such assemblies can be used with or without a shroud, provided that the manifold or other components perform equivalent functions. Further, the fluid dispensing openings have been shown as being innermost with respect to the vent openings in each instance. However, it is within the concepts of this invention to reverse this arrangement. In so doing, the location of the dip tubes and the interrelationship of the valve mechanism and manifold in each embodiment can be changed accordingly.

Other modifications of the dispensing assembly of the present invention for dispensing fluids from multiple containers, while simultaneously and instantaneously venting the fluid containers, will become apparent to those skilled in the art from an examination of the above patent specification and drawings. Therefore, other variations of the present invention may be made that fall within the scope of the following claims, even though such variations were not specifically discussed above.

INDUSTRIAL APPLICABILITY

The dispensing assembly of the present invention can be used whenever simultaneous dispensing of different and possibly incompatible fluids is desired. For example, one container might hold a liquid cleansing solution and the other a bleach, or one an aqueous stain removing formulation and the other a high solvent, enzyme-containing stain removing formulation. While convenience is a factor in dispensing two liquids from a single assembly, it has been found that the simultaneous dispensing of fluids having different properties and different active ingredients can provide performance superior to that of sequential application of the same fluids.

What we claim is:

1. An apparatus for dispensing fluids from multiple containers, while simultaneously and instantaneously venting the fluid containers, said apparatus comprising:

at least two containers, each for containing fluid;

manually operable pumping means for pumping fluid from the containers to dispense the fluid from the apparatus, said pumping means comprising (i) pump actuation means for actuating and deactuating said pumping means, (ii) a reciprocating fluid conduit, which reciprocates upon actuation and deactuation of said pump actuation means and (iii) a discharge nozzle for dispensing the fluid from said apparatus upon actuation of said pumping means;

manifold means connected to an outlet end of each of the fluid containers, said manifold means providing at least one fluid discharge opening and at least one vent opening for each container;

at least one hollow fluid transfer dip tube for each container, each dip tube being connected to a respective fluid discharge opening in said manifold means and extending into a respective fluid container, for withdrawing fluid from the respective container upon deactuation of said pumping means; and valve means connected to the reciprocating fluid conduit of said pumping means and engageable with said manifold means, said valve means opening and closing the fluid discharge openings and air passage to and from the vent openings of said manifold means upon a corresponding pumping actuation and deactuation of said pump actuation means.

2. A dispensing apparatus according to claim 1, wherein said valve means comprises a unitary member connected to the reciprocating fluid conduit for simultaneously opening and closing the fluid discharge openings and the vent openings of said manifold means.

3. A dispensing apparatus according to claim 1, wherein said valve means comprises first and second concentric cylinders nested together with a gap therebetween, each concentric cylinder having an open end and a closed end, the closed end of each being attached to the reciprocating conduit.

4. A dispensing apparatus according to claim 3, wherein an outer one of the first and second concentric cylinders closes the vent openings of the manifold means upon a corresponding pumping deactuation of said pump actuation means.

5. A dispensing apparatus according to claim 3, wherein an inner one of the first and second concentric cylinders acts as a guide for guiding said valve means along an annular extension of the manifold means.

6. A dispensing apparatus according to claim 1, wherein said valve means comprises (i) a first valve member, having a washer shape, affixed to one of an intermediate position of the reciprocating fluid conduit, an upwardly extending outer cylindrical member of the manifold means and a bottom flange portion of the pumping means, and (ii) a second valve member, affixed to an end of the reciprocating fluid conduit, for opening and closing air passage to and from the vent openings while simultaneously opening and closing the fluid discharge openings of said manifold, respectively.

7. A dispensing apparatus according to claim 1, wherein said fluid containers are substantially leakproof when said valve means closes the fluid discharge openings and the vent openings of said manifold means.

8. A dispensing apparatus according to claim 1, wherein said valve means and said manifold are made from materials selected from the group consisting of polyethylene, polypropylene, polyethylene terephthalate and polyvinyl chloride.

9. A dispensing apparatus according to claim 1, wherein said valve means is made of polyethylene, and said manifold is made of polypropylene.

10. A spray bottle combination comprising:

at least two fluid discharge bottles;

a sprayer mechanism, comprising a sprayer actuator, for pumping fluid from the containers to dispense the fluid;

a manifold connected at one end to an outlet end of each of the fluid containers, the manifold providing at least one fluid discharge opening and at least one vent opening for each container; and fluid transfer means providing fluid communication between the fluid discharge openings of the manifold and the sprayer mechanism, the fluid transfer means comprising a valve arrangement, engageable with another end of the manifold, for opening and closing the fluid discharge openings and air passage to and from the vent openings of the manifold upon a corresponding pumping actuation and deactuation of the sprayer actuator.

11. A spray bottle combination according to claim 10, further comprising at least one hollow fluid transfer dip tube for each container, each dip tube being connected to a respective fluid discharge opening in the manifold and extending into a respective fluid container, for withdrawing fluid from the respective containers upon deactuation of the sprayer actuator.

12. A spray bottle combination according to claim 10, wherein the sprayer mechanism further comprises a reciprocating conduit, which reciprocates upon actuation and deactuation of the sprayer actuator, for delivering fluid from the manifold to the sprayer mechanism.

13. A spray bottle combination according to claim 12, wherein the valve arrangement is connected to the reciprocating conduit of the sprayer mechanism, and reciprocates upon reciprocation of the reciprocating conduit when the sprayer actuator is actuated and deactuated, to open and close the respective fluid discharge and vent openings of the manifold.

14. A spray bottle combination according to claim 13, wherein the valve arrangement comprises a unitary member connected to the reciprocating conduit for simultaneously and instantaneously opening and closing the fluid discharge openings and the vent openings of said manifold means.

15. A spray bottle combination according to claim 13, wherein the valve arrangement comprises first and second concentric cylinders nested together with a gap therebetween, each having an open end and a closed end, the closed end of each being attached to the reciprocating conduit.

16. A spray bottle combination according to claim 15, wherein an outer one of the first and second concentric cylinders closes the vent holes of the manifold upon a corresponding pumping deactuation of the sprayer actuator.

17. A spray bottle combination according to claim 15, wherein an inner one of the first and second concentric cylinders acts as a guide for guiding the valve arrangement along an annular extension of the manifold.

18. A spray bottle combination according to claim 13, wherein the valve arrangement comprises (i) a first valve member, having a washer shape, affixed to one of an intermediate position of the reciprocating fluid conduit, an upwardly extending outer cylindrical member of the manifold and a bottom flange portion of the sprayer mechanism, and (ii) a second valve member, affixed to an end of the reciprocating fluid conduit, for opening and closing air passage to and from the vent openings while simultaneously opening and closing the fluid discharge openings of the manifold, respectively.

19. A spray bottle combination according to claim 10, wherein the fluid discharge bottles are substantially leak-proof when the valve arrangement closes the fluid discharge openings and the vent openings of the manifold.

20. A spray bottle combination according to claim 10, wherein the combination provides for simultaneous and instantaneous venting and dispensing when the valve arrangement opens the fluid discharge openings and air passage to and from the vent openings of the manifold.

21. A dispensing apparatus according to claim 10, wherein the valve arrangement is made of polyethylene, and the manifold is made of polypropylene.

* * * * *